US006745868B2

(12) United States Patent
Cheval

(10) Patent No.: US 6,745,868 B2
(45) **Date of Patent: *Jun. 8, 2004**

(54) SAFETY DEVICE

(75) Inventor: Alain Cheval, Lagny-sur-mare (FR)

(73) Assignee: Rollgliss AG, Zurich (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/353,156

(22) Filed: Jan. 28, 2003

(65) Prior Publication Data

US 2003/0150672 A1 Aug. 14, 2003

Related U.S. Application Data

(63) Continuation of application No. 08/803,685, filed on Feb. 21, 1997, now Pat. No. 6,547,033.

(30) Foreign Application Priority Data

Apr. 18, 1996 (GB) ..... 9608018

(51) Int. Cl.[7] ..... A47L 3/04

(52) U.S. Cl. ..... 182/3; 182/5; 182/7; 294/64.2; 248/205.9

(58) Field of Search ..... 183/3–9; 248/205.9, 248/205.8, 362, 363; 294/64.2

(56) References Cited

U.S. PATENT DOCUMENTS

| | | | | | |
|---|---|---|---|---|---|
| 2,404,412 | A | | 7/1946 | Stephens | 248/205.9 |
| 2,420,811 | A | | 5/1947 | Brewster et al. | 248/205.8 X |
| 2,749,097 | A | | 6/1956 | Billner | 248/205.9 X |
| 2,871,053 | A | | 1/1959 | Richter | 248/205.8 X |
| 2,968,460 | A | | 1/1961 | Van Dusen | 248/205.8 X |
| 3,568,959 | A | | 3/1971 | Blatt | 294/64.2 |
| 3,613,904 | A | | 10/1971 | Blatt | 294/64.2 X |
| 3,797,859 | A | * | 3/1974 | Vasquez | 280/179 R |
| 3,837,429 | A | * | 9/1974 | Harris | 182/37 |
| 3,863,568 | A | | 2/1975 | Frederick | 248/205.8 |
| 3,865,333 | A | * | 2/1975 | Fielding et al. | 244/151 B |
| 3,892,287 | A | * | 7/1975 | Bennett | 180/115 |
| 3,910,620 | A | | 10/1975 | Sperry | 248/362 X |
| 4,193,475 | A | * | 3/1980 | Sweet et al. | 182/8 |
| 4,196,882 | A | | 4/1980 | Rognon | 248/205.9 |
| 4,295,543 | A | | 10/1981 | Graham | 182/3 |
| 4,328,761 | A | | 5/1982 | Dwyer | 248/363 X |
| 4,709,782 | A | | 12/1987 | Lipinski | 182/3 |
| 4,775,346 | A | * | 10/1988 | Gunter et al. | 441/129 |
| 4,828,011 | A | * | 5/1989 | Hafer et al. | 164/255 |
| 4,828,306 | A | | 5/1989 | Blatt | 294/64.2 |
| 4,944,478 | A | | 7/1990 | Sullivan | 248/362 X |
| 4,971,591 | A | | 11/1990 | Raviv et al. | 446/177 |
| 5,014,803 | A | | 5/1991 | Urakami | 248/206.4 X |
| 5,036,949 | A | | 8/1991 | Crocker et al. | 182/3 |
| 5,092,426 | A | * | 3/1992 | Rhodes | 182/3 |
| 5,104,077 | A | | 4/1992 | Liu | 248/363 X |
| 5,143,170 | A | | 9/1992 | Hunt et al. | 182/45 X |
| 5,156,233 | A | | 10/1992 | Olsen et al. | 182/3 |
| 5,201,560 | A | | 4/1993 | Golden | 294/64.2 |
| 5,297,651 | A | | 3/1994 | Vandelinde | 182/36 X |
| 5,325,788 | A | * | 7/1994 | Strickland et al. | 104/119 |
| 5,361,866 | A | | 11/1994 | Bell et al. | 182/3 |
| 5,423,466 | A | | 6/1995 | Moon | 248/205.8 X |
| 5,492,141 | A | | 2/1996 | Oberlander | 182/3 X |
| 5,511,752 | A | | 4/1996 | Trethewey | 248/362 X |

(List continued on next page.)

FOREIGN PATENT DOCUMENTS

| | | | | |
|---|---|---|---|---|
| FR | 2638705 | * | 5/1990 | 182/3 |
| GB | 2373537 | * | 9/2002 | 182/3 |

*Primary Examiner*—Bruce A. Lev
(74) *Attorney, Agent, or Firm*—IPLM Group, P.A.

(57) ABSTRACT

A safety device comprises vacuum anchors for attachment to a surface. The anchors are interconnected by a rigid track along which a carriage runs. The carriage includes means for connection to a safety line and harness. Such an arrangement provides enhanced freedom of movement and increased resistance against shearing forces when arresting a fall.

15 Claims, 7 Drawing Sheets

U.S. PATENT DOCUMENTS

| | | | | | |
|---|---|---|---|---|---|
| 5,526,896 | A | | 6/1996 | O'Rourke | 182/3 |
| 5,529,144 | A | | 6/1996 | Henderson | 182/3 |
| 5,685,513 | A | | 11/1997 | Tsukushi | 248/362 X |
| 5,711,397 | A | | 1/1998 | Flora et al. | 182/3 |
| 5,730,246 | A | | 3/1998 | Beard | 182/3 X |
| 6,093,350 | A | * | 7/2000 | Sadinski | 264/40.7 |
| 6,132,145 | A | * | 10/2000 | Treu et al. | 405/224 |
| 6,314,592 | B1 | * | 11/2001 | Stein | 4/579 |
| 6,520,290 | B1 | * | 2/2003 | Carter | 182/36 |
| 6,547,033 | B1 | * | 4/2003 | Cheval | 182/3 |
| 2002/0152921 | A1 | * | 10/2002 | Hudson | 104/95 |

* cited by examiner

FIG. 1
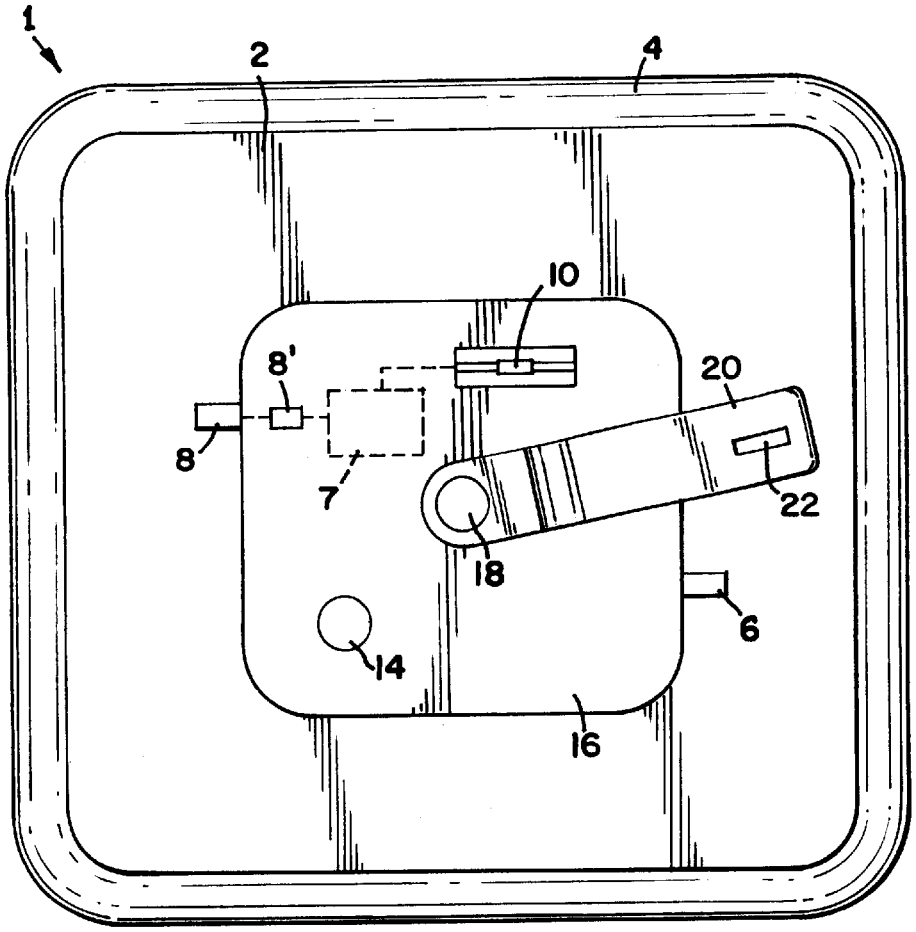
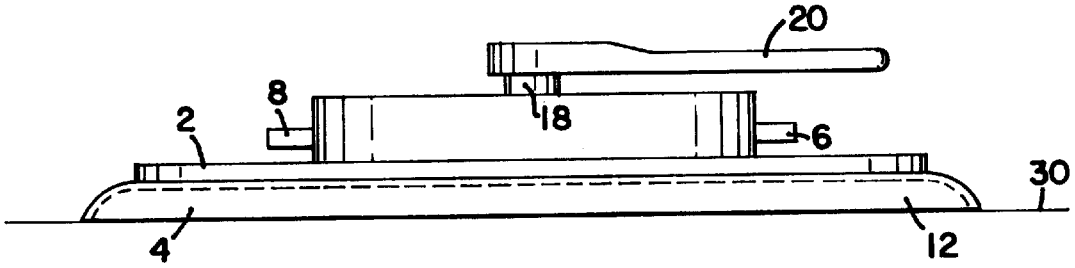
FIG. 2

SAFETY DEVICE

This is a continuation of U.S. patent application Ser. No. 08/803,685, filed Feb. 21, 1997 now U.S. Pat. No. 6,547,033.

BACKGROUND OF THE INVENTION

1. Field of the Invention

The present invention relates to a safety device, and in particular to a device enabling personnel to perform maintenance or inspection procedures on large items, such as the wing or tail sections of an aircraft, the sides of storage tanks, ships, submarines and other large structures.

2. Description of the Prior Art

Because of the large open spans required in hanger buildings suitable for large aircraft, it is impractical to install fixed safety lines in these structures since the sag that would be induced in a line by the weight of a person falling and being arrested by the line could cause that person to strike a lower obstruction before their fall was arrested or to slide in an uncontrolled manner onto a protruding platform or lower part of an aircraft.

SUMMARY OF THE INVENTION

According to a first aspect of the present invention there is provided a safety device comprising an anchor which can be secured to a surface without damaging the surface, the anchor incorporating attachment means for attachment to a safety line.

It is thus possible to provide a safety device which can be positioned on a structure in the vicinity where a person is working thereby ensuring that the person is attached to the safety device by a relatively short safety line.

Preferably the anchor attaches to the surface by means of suction. Alternatively, other forms of attachment may be used, such a magnetic attraction generated by an electromagnet or a permanent magnet.

Preferably the anchor comprises a rigid element having a sealing element extending from a first side thereof. The rigid element may be formed as a plate. The sealing element may be formed as a seal extending around the periphery of the rigid element.

The plate may, for example, be circular or rectangular. A substantially square plate having chamfered corners has been found to be particularly useful in an embodiment of the present invention.

The plate is preferably made of a lightweight and strong material, such as aluminium or an aluminium alloy, as this enables a physically strong anchor to be formed which is still sufficiently light to be manually handled with ease. In an embodiment of the present invention, the plate is substantially 450 mm×450 mm with a thickness of approximately 10 mm. The plate may be planar or it may be curved in order to accommodate the curvature of a structure such as an aircraft fuselage. A planar plate may be used as an anchor on a curved fuselage provided that the radius of curvature is not too small. Similarly, a curved plate may be attachable to both a curved surface and a plane surface provided that the radius of curvature induced in the plate is not too small.

Advantageously, the seal is profiled to have a plurality of sealing lips. The provision of a plurality of lips provides enhanced integrity against gas leakage through the seal. In a preferred embodiment, the seal comprises a primary sealing lip and a secondary, tertiary, and quaternary lips which act as backup seals.

Preferably, the seal is made of a rubber or rubber-like material. Nitrile rubber is especially preferred as it has excellent resistance to chemical attack from items such as fuel, skydrol or mineral based oils used in aircraft systems.

The plate and seal cooperate to define a working volume of the anchor. This working volume becomes a sealed working chamber when the anchor is attached to the surface.

Preferably, each anchor carries its own control valves. One or more valves may be attached to the rear surface of the plate. Advantageously, the valves are positioned in a protective enclosure so that the valves cannot be inadvertently operated, for example, by someone accidentally tripping over the anchor. The valve or valves are operable to selectively to connect the working chamber to a vacuum source, or to vent the working chamber to the atmosphere. Advantageously the valve or valves may enable the working chamber to be isolated.

Preferably, each anchor comprises at least one coupling to enable it to be attached to or uncoupled from a vacuum supply line. Advantageously the couplings are quick release couplings. Preferably, each anchor carries two or more couplings in gas flow communication with one another such that a plurality of anchors may be connected together in series. Preferably, each coupling includes a self-sealing valve such that air is not admitted into the anchor in the event of accidental disconnection of a coupling.

Preferably, each anchor includes a vacuum reservoir. The reservoir can be selectively coupled to the working chamber of the anchor in order to reduce the gas pressure within the working chamber even when the vacuum supply to the anchor has been interrupted or removed.

Advantageously, the or each anchor carries a centrally mounted rotatable arm on its rear surface. The arm has an aperture formed therein for accepting a karabiner or other clip by which a connection can be made between the anchor and a safety line. The arm is rotatable thereby enabling a person to work safely within a predetermined radius of the anchor.

Alternatively, two anchors may be provided with a safety line that runs between them. A further safety line is then connected in sliding arrangement to the line secured between the two anchors. Such an arrangement enables a greater working area to be covered than is possible using a single anchor alone.

Preferably, one or more anchors are provided in combination with a substantially rigid track. Use of a rigid track reduces the shearing loads applied to the or each anchor when restraining a falling body. In a preferred embodiment, anchors are provided at opposing ends of track sections. Each track section is approximately 2.5 metres long and is provided with male and female ends, or another coupling arrangement, such that adjacent sections of track can be secured together. It is thus possible to form continuous track sections to any desired length. Advantageously, a carriage engages the track and is longitudinally moveable with respect thereto in order to give maintenance personnel easy access to a large area of structure whilst still providing excellent fall restraint.

Advantageously, a trolley is provided for storing the anchors or the track sections having anchors attached thereto. The trolley may also include a vacuum source together with flexible piping. The vacuum source may be driven from an electrical supply, a compressed air supply, a hydraulic supply or an internal combustion engine. Advantageously, the vacuum source also includes a safety system which will give an audible and/or visible warning in the event of failure of the vacuum system and/or the vacuum pump power source.

According to a second aspect of the present invention, there is provided a fall arrest system comprising a plurality of track elements connectable together to form an elongate track and a carriage moveable along the track, the carriage having a connector for connection to a safety line, in which each track section has at least one vacuum anchor so that the track can be secured to the surface of a structure without substantially damaging the surface.

According to a third aspect of the present invention, there is provided a method of fall restraint comprising placing at least one vacuum anchor against a suitable surface, operating the anchor so as to secure it to the surface without damaging the surface and attaching a safety line to the anchor.

BRIEF DESCRIPTION OF THE DRAWINGS

The present invention will be further described, by way of example, with reference to the accompanying drawings in which:

FIG. 1 is a plan view of an anchor constituting an embodiment of the present invention;

FIG. 2 is a side view of the anchor shown in FIG. 1;

DETAILED DESCRIPTION OF A PREFERRED EMBODIMENT

Figure 3:
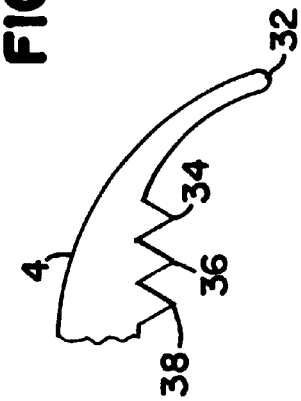
FIG. 3 is a cross-section through the seal of the anchor shown in FIG. 1.

The anchor 1 shown in FIG. 1 comprises a back-plate 2 which carries a nitrile rubber seal 4 around its periphery. The seal 4 has a dished profile and faces away from the plate 2. The rear surface of the plate 2 carries first and second quick-release vacuum couplers 6 and 8 which incorporate in-built check valves (one-way valves) and which are in gas flow communication with each other. A vacuum reservoir (not shown) is in gas flow communication via a one-way valve with the couplers 6 and 8 such that the reservoir becomes evacuated when either of the couplers 6 and 8 is connected to a vacuum supply line. An outlet of the vacuum reservoir is connected via a manually operable valve 10 to a working volume or chamber 12 defined by the plate 2 and the seal 4. A pressure gauge 14 is in communication with the working volume 12 and measures the pressure therein. The connectors 6 and 8, the vacuum reservoir, the valve 10 and the pressure gauge 14 are covered by a second plate 16 to protect them from accidental damage. The second plate 16 is firmly secured to the plate 2 and has an upstanding pin 18 thereon which forms the pivot for a rotatable arm 20. The arm 20 has a recess 22 formed therein which acts a point of attachment for a safety line.

In use, the anchor is placed against a surface, such as an aircraft wing or fuselage and a vacuum supply line is connected to one of the couplers 6 and 8. This causes the reservoir to become evacuated. Once the anchor has been placed at the desired position, the valve 10 is then opened so as to connect the working chamber 12 formed by the back plate, the seal and the surface to the vacuum supply line via the vacuum reservoir. The seal 4 makes a gas tight seal with the surface 30 and consequently the pressure within the working chamber 12 becomes reduced causing the anchor to be held against the surface 30 by virtue of the atmospheric pressure acting on the plate 2. Once the anchor has become secured to the surface 30, a safety line can be attached to the arm 20. The valve can be left open so as to provide a continuous path to vacuum (via the various one-way valves) so that minor leaks do not cause the anchors to release from the surface.

The anchor has dimensions of approximately 450 mm×450 mm. However, the distance between the innermost sealing lips of the anchor seals is approximately 400 mm. When the working volume is evacuated to a vacuum level of substantially 150 mBar. The force required to pull the anchor away from the surface 30 is approximately 1500 daN, i.e. equivalent to 1500 Kg force. The maximum shear load that the anchor can withstand before moving is dictated by the coefficient of friction between the rubber and the surface 30. However, typically the coefficient between rubber and a clean aluminium surface (i.e. the skin of an aircraft) is $\mu$=0.55. Thus, the anchor is able to stand a shearing force in the region of 800 daN.

The pressure gauge 14 is calibrated to show the level of vacuum but the face is also divided into a red portion and a green portion. The needle of the pressure gauge does not become aligned with the green portion until the vacuum level is down to approximately 300 mBar. The anchor should not be used until such a level of vacuum has been achieved.

FIG. 3 schematically shows the cross-section of the seal 4 in greater detail. The seal has a primary outer lip 32 which forms the main seal between the anchor 1 and the surface 30. However, the seal 4 is also provided with secondary, tertiary and quaternary lips 34, 36 and 38 respectively, which provide backup seals in the event that the primary seal 32 is breached. It will be appreciated that the anchor can be used if any one of the four sealing elements 32 to 38 is intact. Furthermore, the anchor is still useable if all of the sealing elements 32 to 38 are damaged provided that the breaches occur at different circumferential positions around the seal. Under such circumstances, the seal can still function as a labyrinth seal in order to maintain the vacuum within the working volume 12.

Figure 4:
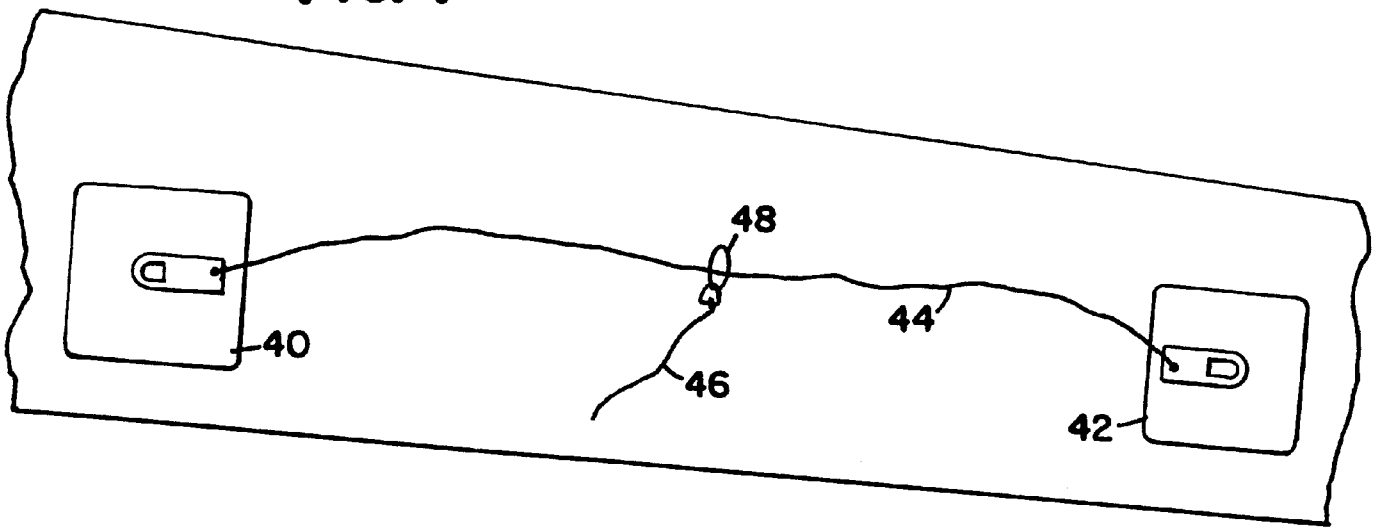
FIG. 4 is a schematic diagram of a safety system using two anchors tethered together.

FIG. 4 schematically illustrates a fall restraint system comprising two vacuum anchors. The vacuum anchors 40 and 42 are tethered together via a flexible safety line 44. A further safety line 46 connected to a proprietary safety harness (not shown) is connected to the safety line 44 via a karabiner 48. Typically the safety line 46 is 1.8 metre lanyard fitted with a built-in shock absorber comprising a folded portion of webbing stitched to itself with severable stitching. The lanyard is designed such that the stitching fails when the load on the lanyard is in the region of 500 Kg. This allows the web portion to unravel and the energy of the falling person is dissipated during the process of breaking the stitching. Thus, the load applied transversely to the line interconnecting the vacuum anchors 40 and 42 is limited to approximately 500 Kg. It will be appreciated that the transverse load is converted by the safety line 44 into a substantially longitudinally acting shear force. The magnitude of the force is dependent upon how much the line 44 can be deviated from the straight line path between the anchors 40 and 42 before the line 44 becomes taut. Resolving the loads into a triangle of forces indicates that the safety line should be sufficiently slack in order that it can assume an angle of at least 30° with respect to the nominal line interconnecting the vacuum anchors.

The applicants realized that the load carrying capability of the safety system could be further enhanced if the connection between adjacent anchors did not flex to any substantial extent when it was loaded.

Figure 5:
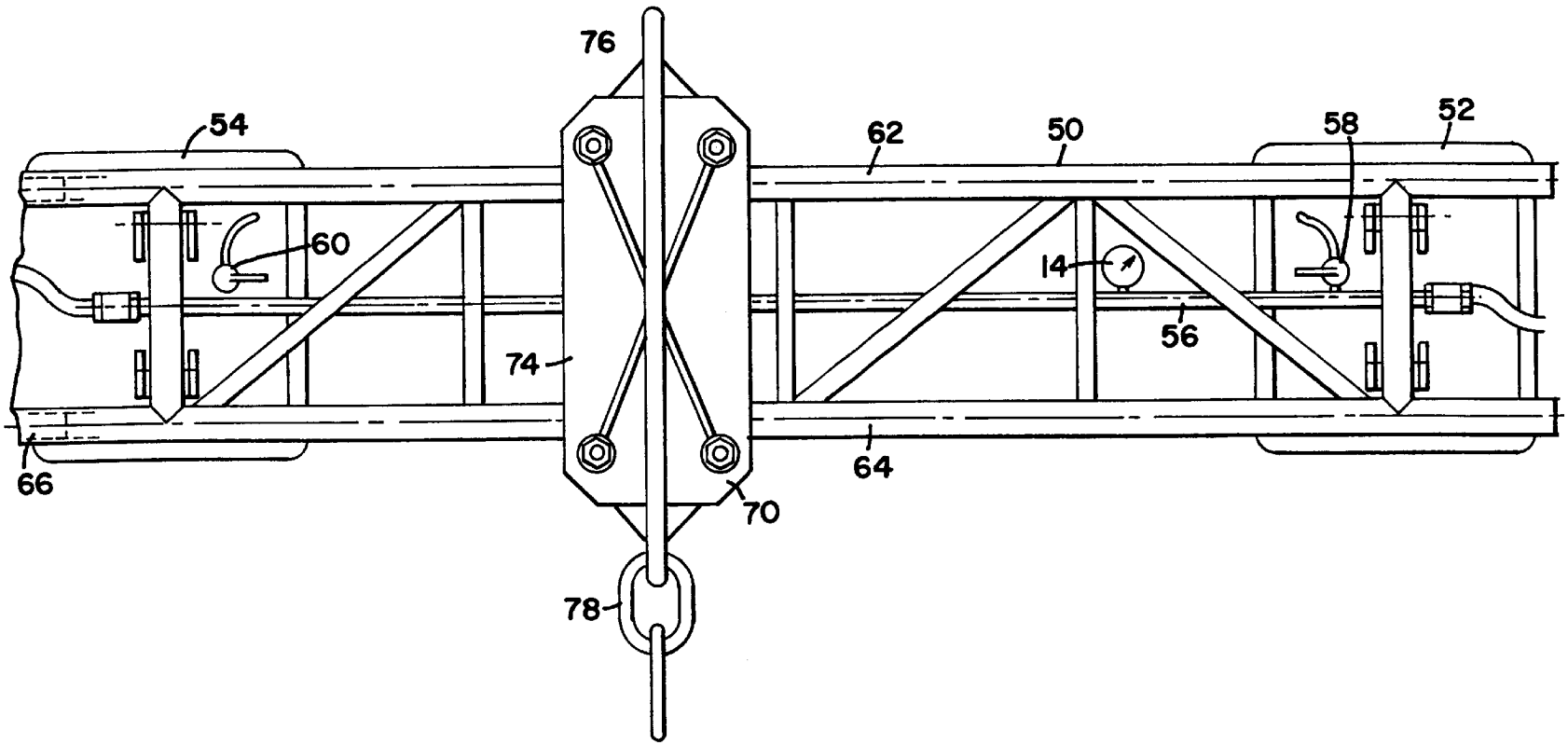
FIG. 5 is a plan view of a frame section of a safety system constituting a second embodiment of the present invention.

FIG. 5 schematically illustrates a further embodiment of the present invention in which a track 50 interconnects pairs of vacuum anchors 52 and 54. The anchors 52 and 54 are similar to the anchor shown in FIG. 1, although the rotatable arm 20 has been replaced by fixed joints to the frame 50. Additionally, each anchor now only carries one releasable vacuum coupling, and a fixed vacuum line 56 now extends between the anchor 52 and 54.

Figure 6:
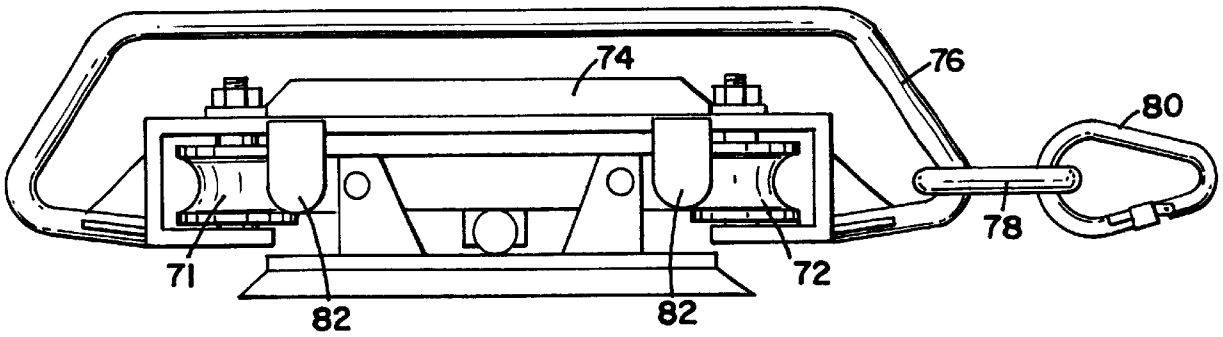
FIG. 6 is a cross-section through the carriage shown in FIG. 5.
Figure 9:
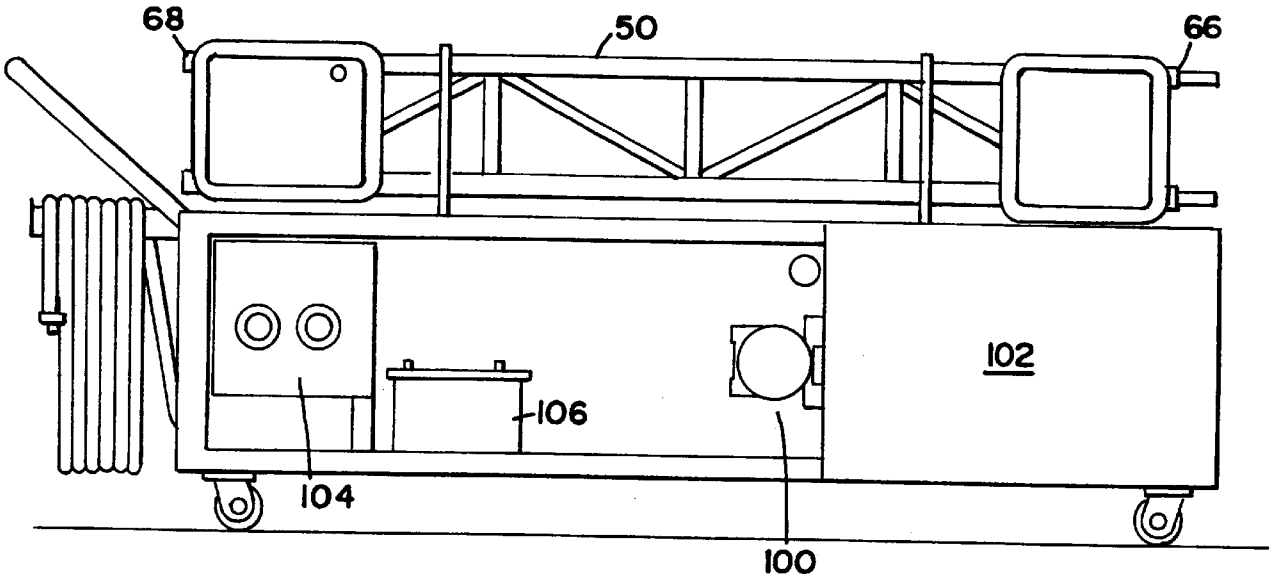
FIG. 9 schematically illustrates the side view of a trolley for transporting the safety system shown in FIG. 7.

The line 56 carries a single vacuum gauge for the assembly and the vacuum reservoirs have been omitted (although they can be retained). However, the line 56 (which has check valves at each end) effectively acts as a vacuum reservoir. Each anchor 52 and 54 is fitted with a vacuum gauge, a check valve, and has a manually operated valve 58 and 60 respectively, which can be operated to evacuate the working space of each anchor or to allow the working space to be vented to atmospheric pressure. The track 50 comprises two parallel rails 62 and 64 which are held in spaced relationship and against flexing by a plurality of cross members. The opposing ends of the rails are profiled such that one end forms a male connector 66 and the other end forms a female connector 68 (as illustrated in FIG. 9). A carriage 70 is provided in sliding engagement with the rails 62 and 64. The carriage is shown in greater detail in FIG. 6. The carriage comprises opposed pairs of guide wheels 71 and 72 which are held in engagement with the tracks 62 and 64 by a metal frame 74. A substantially D-shaped guide ring 76 extends from one side of the carriage to the other, and carries a sliding link 78 thereon. A karabiner 80 of a safety lanyard can be attached to the link 78 in order to secure a work person to the safety system.

Figure 8:
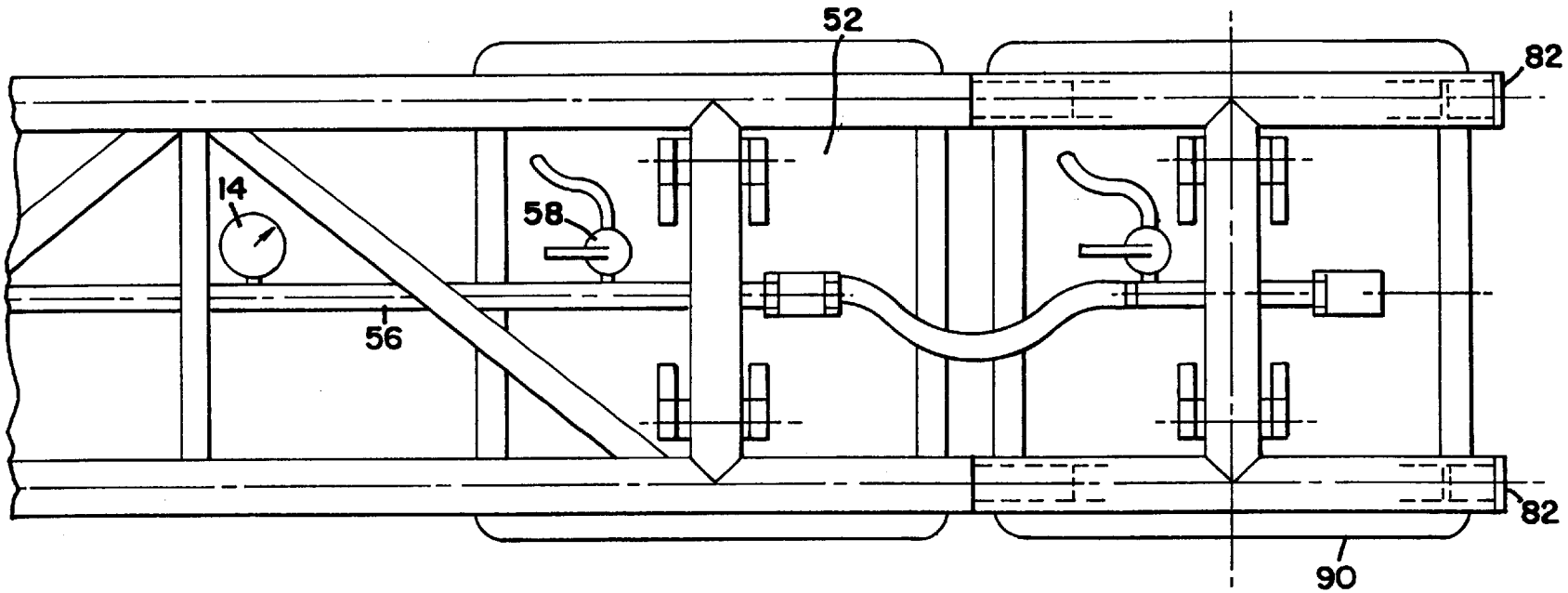
FIG. 8 schematically illustrates an end of the safety system illustrated in FIG. 7.

FIG. 8 illustrates an end section of the safety system. The end sections additionally carry buffer plates 82 which act to prevent the carriage 70 from sliding off the end of the rails.

Figure 7:
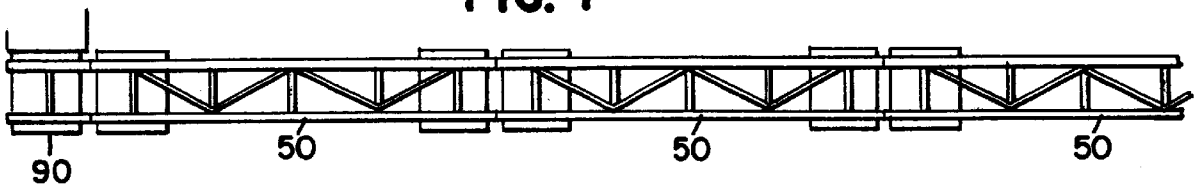
FIG. 7 schematically illustrates a plurality of frame sections assembled together.

Each track section is approximately 2.5 metres long. A plurality of track sections 50 can be joined end-to-end, as shown in FIG. 7, to form an elongate section of track. As noted hereinabove, the tracks are provided with male and female end connectors such that the tracks firmly engage one another and a load borne by one track can be substantially supported by an adjacent track section. As an alternative to profiling the ends of each track so as to form male and female connectors, the ends may be identical and back-to-back connectors may be provided for securing adjacent sections of track to one another. As shown in FIG. 7, the end-most element of the completed assembly comprises an end anchor 90. Thus, the anchors occur in pairs and each pair is separated from a neighboring pair by a track element. It should be noted that two end anchors 90 could be joined together to form a short complete track. The end anchor 90 is illustrated in greater detail in FIG. 8. The construction of the anchor 90 is identical to the construction of anchors 52 and 54 in the track section. However, the anchor 90 is only provided with a short section of track approximately 45 cm long and the track is provided with the buffers 82. Once the work has been completed, the anchors can be released by venting them to atmosphere.

Figure 10:
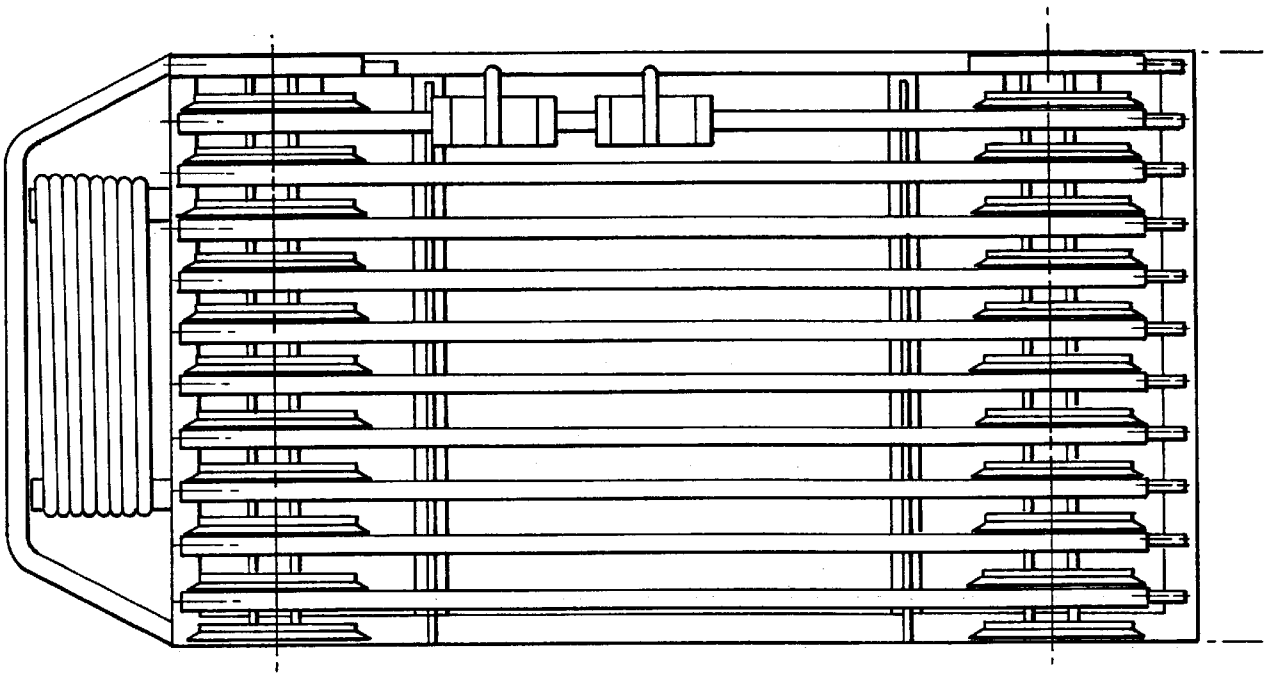
FIG. 10 illustrates the trolley of FIG. 9 in plan view.

FIG. 9 illustrates a trolley for carrying a plurality of frame sections. The trolley includes a vacuum source 100 in the form of a vacuum pump and a vacuum reservoir 102. As shown, the pump 100 is electrically operated and is controlled by a switch 104. A backup supply 106 in the form of a battery is also provided to operate an alarm system in the event that the mains power fails. The alarm system may include a klaxon or other audible indicator to warn of a power supply failure or loss of vacuum. The trolley can support a plurality of frame sections, as shown in the plan view of FIG. 10, together with sufficient vacuum hose to connect the trolley to the first of the frame sections.

Depending upon the operator's requirements, the trolley may also include an internal combustion engine, either coupled to a generator or directly coupled to a vacuum pump, or a compressed air vacuum generator.

Figure 11:
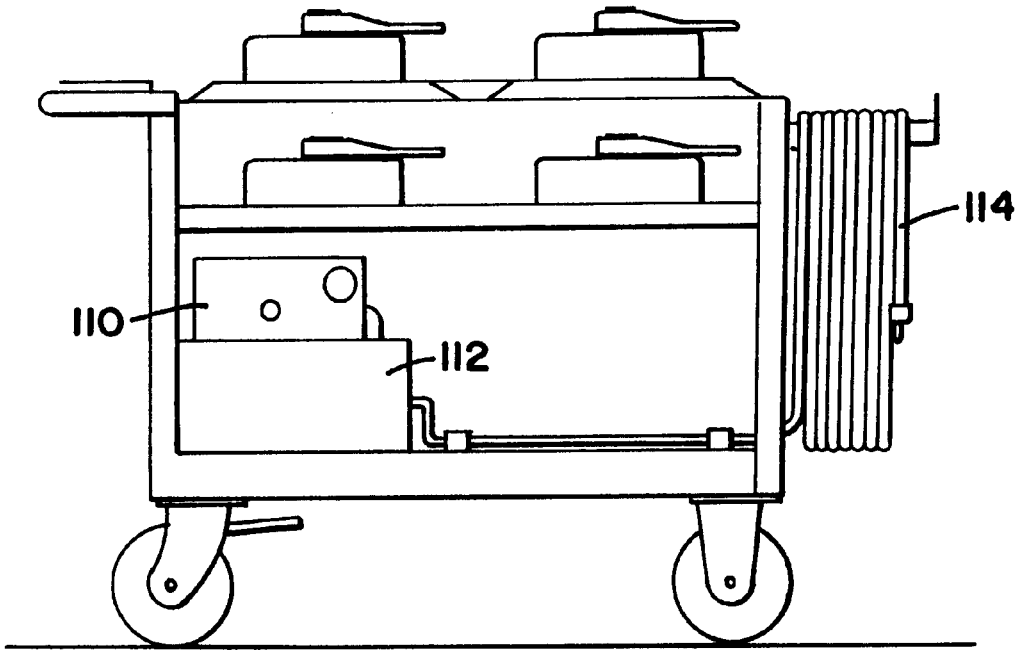
FIG. 11 schematically illustrates a trolley for a plurality of anchors of the type shown in FIG. 1.

A similar design of trolley may also be provided to carry the single vacuum anchor units of the type shown in FIG. 1. Such a trolley is illustrated in FIG. 11 and includes storage for a plurality of anchors, a source of vacuum comprising a pump 110 and reservoir 112 together with vacuum line 114 for interconnecting the anchors to the trolley and the anchors to one another.

In use, it is advantageous to check that each anchor is safely positioned over a surface and that air is not leaking past the seal or through a fracture or defect in the surface. In order to check the functionality of the system, each anchor is placed on the surface and connected to the vacuum supply. The valve on the anchor is then operated to the "HOLD" position so as to attach the anchor to the surface. The vacuum gauge should immediately register in the green segment of the dial. The vacuum hose is then disconnected and the vacuum level shown on the gauge should not fall. If the vacuum level does decrease (noticeably within approximately thirty seconds), the anchor should not be used. Inspection may reveal debris breaking the seal or rivet holes in the surface.

It is thus possible to provide a safety system for restraining falls in which vacuum operated anchors can be attached to the surface of a structure such as an aircraft wing, fuselage or tailplane without damage to the surface. Additionally, the anchors can be interconnected by rigid rails to form an elongate track allowing ease of movement along the structure while enabling a short length of safety line to be used, thereby decreasing the risk of injury in a fall.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A fall protection system, comprising:

a structure selected from a group consisting of an aircraft, a ship, and a submarine;

at least one portable anchor;

a safety line adapted to be interconnected between a person and the at least one portable anchor, wherein the safety line is configured to absorb shock in response to an applied load of 500 kg; and a securing means for securing the at least one portable anchor to an exterior surface on the structure without penetrating the surface, wherein the securing means is configured to withstand an applied load of more than 500 kg.

2. The fall protection system of claim 1, wherein the at least one portable anchor cooperates with the exterior surface of the structure to define a chamber, and the securing means establishes a suction force within the chamber.

3. The fall protection system of claim 2, wherein the securing means includes a low pressure source that remains in communication with the chamber after the suction force is established.

4. The fall protection system of claim 2, wherein the at least one portable anchor includes a control valve that is operable to vent the chamber to atmosphere.

5. The fall protection system of claim 2, wherein the at least one portable anchor includes at least one quick-release vacuum coupling configured for connection to the securing means.

6. The fall protection system of claim 5, wherein the at least one portable anchor includes a one-way check valve incorporated into each said quick-release vacuum coupling.

7. The fall protection system of claim 2, wherein the at least one portable anchor includes a vacuum reservoir.

8. The fall protection system of claim 2, wherein the suction force is 150 mBar.

9. The fall protection system of claim 2, further comprising a warning means for warning the person if the suction force is greater than 300 mBar.

10. The fall protection system of claim 2, wherein the at least one portable anchor includes at least two peripheral, concentrically nested sealing lips.

11. The fall protection system of claim 1, wherein the at least one portable anchor includes a base, and a rotatable and having a first end rotaxably connected to the base, and a second end that is configured for connection to the safety line.

12. The fall protection system of claim 11, wherein the at least one portable anchor includes a first said anchor, a second said anchor, and a track interconnected therebetween.

13. The fall protection system of claim 12, wherein a trolley is movably mounted on the track for movement along the track, and the safety line is connected to the trolley.

14. The fall protection system of claim 1, wherein the securing means is configured to withstand 1500 kg of pulling force exerted in a direction perpendicular to the exterior surface.

15. The fall protection system of claim 1, wherein the securing means is configured to withstand 500 kg of shear force exerted in a direction parallel to the surface.

* * * * *

UNITED STATES PATENT AND TRADEMARK OFFICE

CERTIFICATE OF CORRECTION

PATENT NO. : 6,745,868 B2
DATED : June 8, 2004
INVENTOR(S) : Alain Cheval

It is certified that error appears in the above-identified patent and that said Letters Patent is hereby corrected as shown below:

Column 8,
Line 8, insert -- arm -- after "rotatable".
Line 8, delete the second "and".
Line 9, delete "rotaxably" and insert therefore -- rotatable --.
Line 12, delete "11" and insert therefore -- 1 --.

Signed and Sealed this

Fifteenth Day of February, 2005

JON W. DUDAS
*Director of the United States Patent and Trademark Office*